United States Patent [19]

Dritz

[11] Patent Number: 4,600,394

[45] Date of Patent: Jul. 15, 1986

[54] MARINE PROPULSION UNIT

[76] Inventor: Theodore D. Dritz, 1240 El Sur Way, Sacramento, Calif. 95825

[21] Appl. No.: 638,633

[22] Filed: Aug. 6, 1984

Related U.S. Application Data

[63] Continuation of Ser. No. 376,683, May 10, 1983, abandoned.

[51] Int. Cl.[4] ..... B63H 11/00

[52] U.S. Cl. ..... 440/38; 440/47; 440/89; 440/900

[58] Field of Search ..... 440/38, 47, 89, 48, 440/49, 900; 60/221; 416/176 A

[56] References Cited

U.S. PATENT DOCUMENTS

| | | | |
|---|---|---|---|
| 2,636,467 | 4/1953 | Johnson | 440/38 |
| 3,249,083 | 5/1966 | Irgens | 440/38 |
| 3,943,876 | 3/1976 | Kiekhaefer | 440/89 |
| 3,970,027 | 7/1976 | Jackson | 440/47 |
| 3,993,015 | 11/1976 | Klepacz et al. | 440/47 |
| 4,023,353 | 5/1977 | Hall | 440/89 |

FOREIGN PATENT DOCUMENTS

| | | | |
|---|---|---|---|
| 889233 | 7/1953 | Fed. Rep. of Germany | 416/176 A |
| 764860 | 5/1934 | France | 416/176 A |
| 998232 | 2/1983 | U.S.S.R. | 440/38 |

OTHER PUBLICATIONS

Yachting Magazine, vol. 106, No. 5, pp. 70–71, Nov. 1959.

*Primary Examiner*—Trygve M. Blix
*Assistant Examiner*—Edwin L. Swinehart
*Attorney, Agent, or Firm*—Arthur A. March

[57] ABSTRACT

There is provided herewith a marine propulsion unit which is designed for intensifying or increasing the thrust obtained by an impeller such as a propeller for standard, outboard or inboard/outboard marine propulsion systems. The unit design incorporates an axial flow or screw type impeller operating within a housing which terminates in an area of reduced cross-section which augments or intensifies the thrust delivered by the impeller. The impeller blades virtually abut the inner circumference and fill the cross-sectional area of the housing near the inlet port.

15 Claims, 8 Drawing Figures

FIG. 3
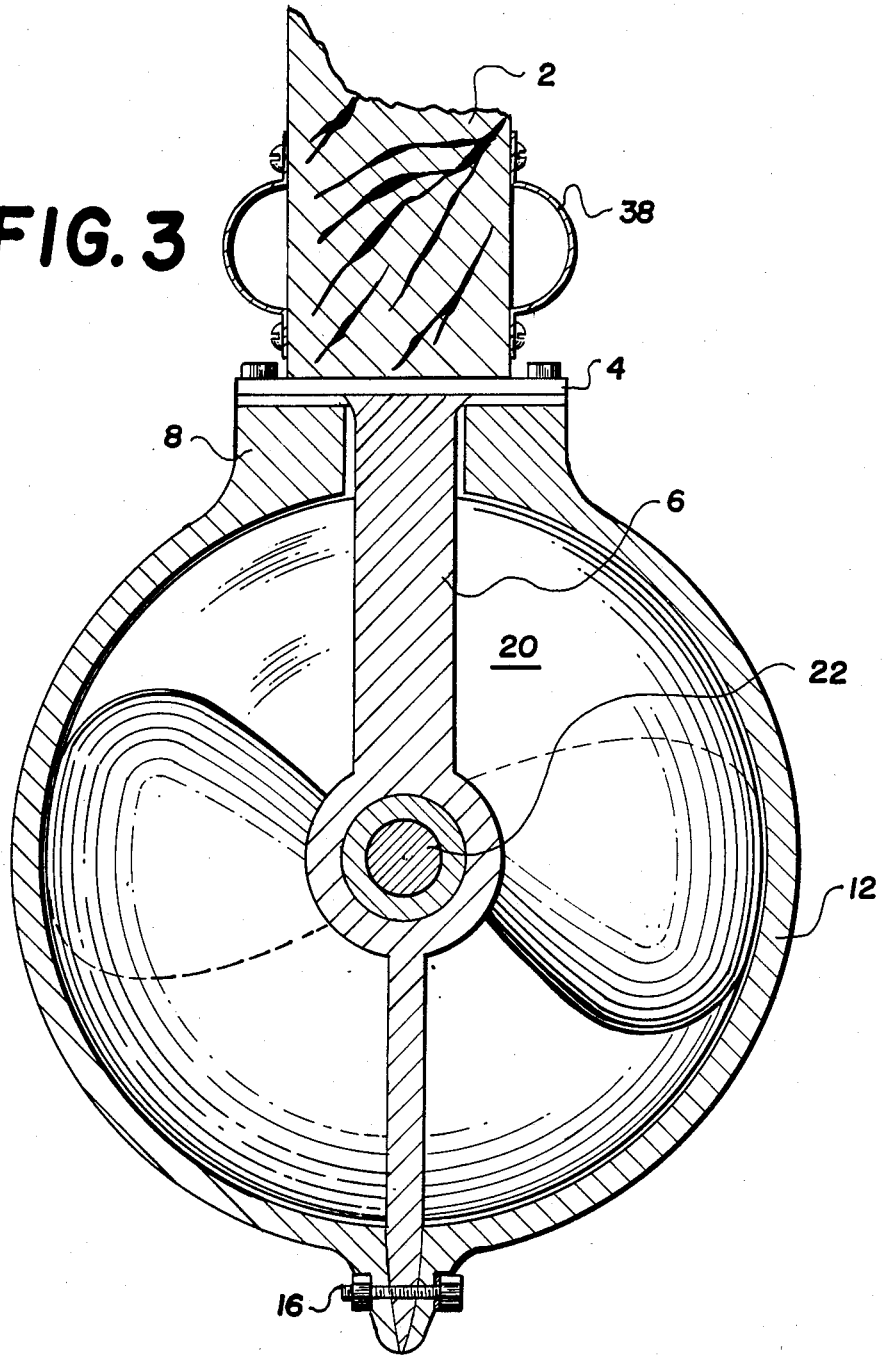
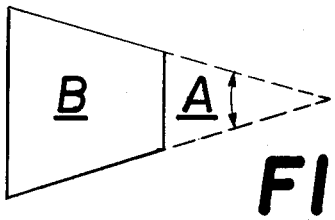
FIG. 4

MARINE PROPULSION UNIT

This is a continuation of application Ser. No. 376,683 filed on May 10, 1983, now abandoned.

BRIEF DESCRIPTION OF INVENTION

This invention relates to marine propulsion units in general and specifically to a marine propulsion unit in which a hydraulic thrust replaces the standard propellers used on outboard systems, inboard systems, or inboard-outboard systems.

Particularly the invention relates to a marine propulsion unit which may be easily and readily installed on existing systems and which intensifies or augments the hydraulic thrust obtained by the replaced system.

The principal operation of the system of this invention is involved in capturing the surrounding fluid such as water without dissipation of the existing relative velocity, providing an additional pressure or head by means of an axial flow impeller operating within a unique housing structure from which the water is discharged at an increased velocity so as to produce optimum thrust, that is to say an augmented or intensified thrust.

As will be seen from the explanation given below, the system is basically a high volume, low pressure system with high efficiency pumping or water circulation with a uniquely low system pressure loss. The principle of its operation is to capture water without dissipating the stagnation pressure, provide additional pressure by means of an axial flow impeller and to discharge water at a velocity to provide optimum thrust, stagnation pressure being that pressure or head that results from converting the total relative velocity head to a combination of velocity head and static pressure at the entrance to the unit. The velocity head is the relative velocity between the hull and the water immediately adjacent to the hull expressed as $(V^2)/2g$ where V is the relative velocity in feet/sec., and g is the acceleration due to gravity.

The system of this invention basically comprises an axial fluid impeller with means for rotating the same, a housing for said propeller, an unencumbered inlet at the forward end of said housing and an outlet, or egress, at the opposite end of the housing. The outlet portion is preferably of a frustoconical design, which may or may not be equipped with longitudinal devices or vanes for the elimination or partial elimination of the turbulent flow created in the housing chamber by the impeller. The outlet means or "nozzle" may be an integral part of the housing chamber structure or it may be designed to be detachable therefrom and replaced with nozzles having different Venturi effects, that is to say, having different length-to-slope and area ratios. For example, it has been found that nozzles which have optimum effect will have slopes of from about 30° to 60° total included angle, and an area ratio (A:B) of from about 2:1 to about 3:1, these terms being defined as indicated in FIG. 4 of the drawings.

The inlet design for the impeller housing provides for the accepting of all fluid which approaches the inlet at maximum boat speed thereby minimizing drag. The unit performs satisfactorily without cavitating and with minimum submergence above the top of the inlet section because at all performance levels surface coring at the inlet is not present. This feature, of course, improves the "draught" characteristics of the vehicle equipped with the system and the inlet design and the quality of minimum submergence both provide a minimum of parasitic drag at rated operating conditions.

In addition to the thrust augmenting or intensifying effect of the marine propulsion unit of this invention the axial impeller is practically impossible to foul or to become wound with fiberous matter sometimes present in operating fluids. Additionally the impeller may not be damaged by either ground contact or floating debris which is the case with normal propelling devices. Sand injection can also be tolerated as impeller/housing clearances need not be closer than $\frac{1}{8}''$.

The unit of this invention is also completely safe. It is impossible for a person to come in contact with the rotating impeller either in operation in the water or when the unit is not submerged. It is also impossible to lose the impelling device which is common with the prior art impellers.

As was stated generally above the propulsion unit of this invention is designed to be used as an accessory to current models of either an outboard, or an outboard-inboard unit or may be specially fitted for inboard models. As an accessory, it may be easily and quickly installed without structural modification of existing units and the motor drive may be returned to its original configuration whenever desired by simply removing the adaptor and re-installing the original equipment.

The design of the unit minimized inlet losses and provides for pumping at the most efficient differential pressure which is consistent with optimum basic thrust.

The thrust imparted to a unit to which an impeller is attached is calculated in accordance with the following formula:

$$F=(W/g)(V_1-V_2)+A(P_1-P_2)$$

wherein

F=The pounds of thrust
W=The pounds of water per second
$V_1$=Exhaust velocity in feet per second
$V_2$=Inlet velocity in feet per second
g=Acceleration due to gravity (32.2 Ft./Sec.$^2$)
A=Nozzle exit area in square inches
$P_1$=Exit pressure in pounds per square inch
$P_2$=Ambient static water pressure in pounds per square inch.

The design of the unit which is consistent with the basic thrust formula given above results in maximized thrust by optimizing the nozzle and impeller combination consistent with both available shaft horsepower and predicted inlet velocity. The unit is designed to perform within the available torque of the internal combustion engine characteristic curve which typically produces maximum torque at rated speed. Torque values drop off rapidly at lower speeds. The unit (impeller and nozzle) must be sized so that shaft horsepower required from start-up to full speed never exceeds the available shaft horsepower. But, to optimize performance both impeller pitch and diameter and nozzle contraction ratio must be specifically configured to approach available shaft horsepower at rated speed.

Variables that are considered in the design of an optimum nozzle and impeller combination to obtain maximum F values (thrust) are as follows:

(1) Inlet velocity (boat speed)
(2) Axial or screw pump shaft torque characterists
(3) Axial or screw pump speed/head/efficiency characteristic (4) Nozzle contraction ratio The effect of variation of inlet velocity and shaft torque are straightforward. Pitch and diameter of the impeller determine pump head in a fixed configuration. This pump head varies with speed which in turn establishes torque/speed relationship; of prime importance as previously described. Also pitch and diameter will be adjusted to obtain maximum efficiency, that is, utilization of all available torque at rated speed.

The nozzle contraction ratio and contour (slope) determine both ($P_1$) head and discharge velocity ($V_1$), both significant factors in the thrust formula.

Of importance is the factor that the projected area covered by the impeller is at least 100% of the inner area of the inlet housing. This makes the $A(P_1-P_2)$ factor totally apply. Furthermore blade overlap is of importance to obtain the full effect of the pressure differential. In a two blade impeller the overlap of the leading edge of one blade over the trailing edge of the adjacent blade should be approximately 30° of arc; in a three blade impeller 20°; in a four blade impeller 15°; etc.

SPECIFIC DESCRIPTION OF INVENTION

The invention will be more clearly explained by reference to the attached drawings in which FIG. 1 represents a cross-sectional view of one embodiment of the invention illustrating a detachably mounted egress means or nozzle cone;

FIG. 3 is a vertical section taken along lines 3—3 of FIG. 1;

FIG. 4 is a diagram of an impeller cone showing the areas A and B and the included angle determining the slope of the sides;

Figure 5:
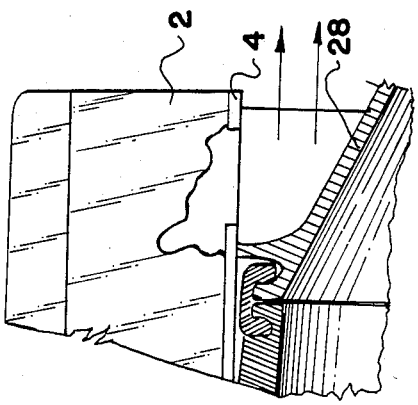
Figure 1:
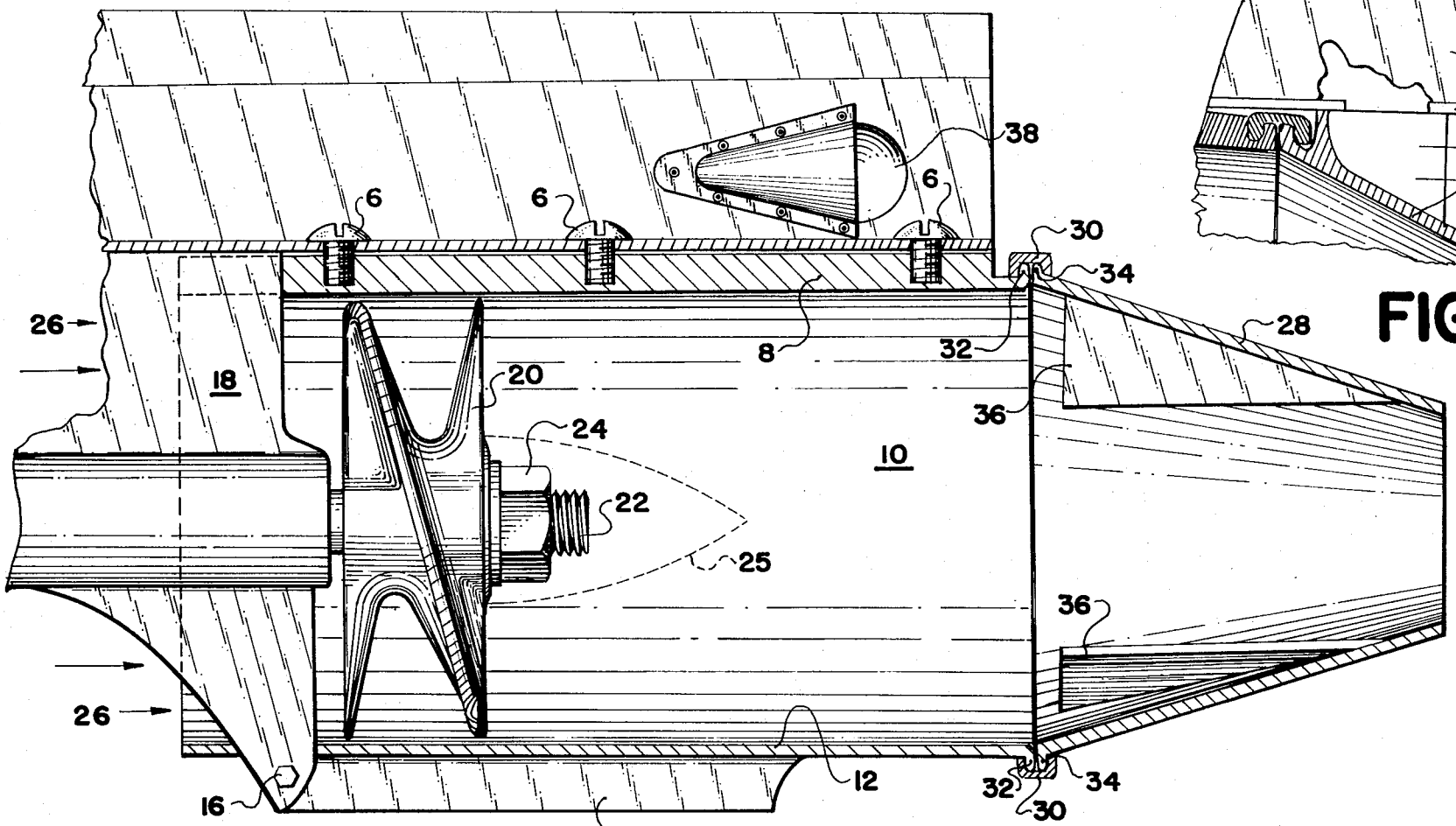
Figure 6:
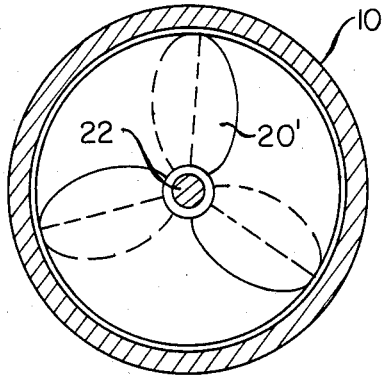
Figure 7:
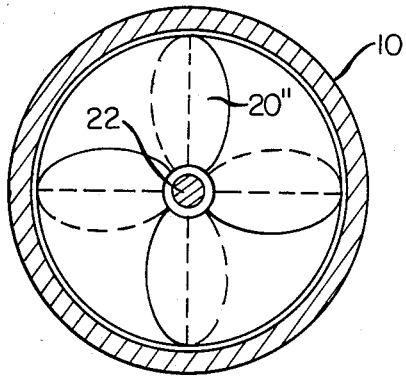

FIG. 5 is a schematic partial view showing details of an alternative embodiment of the arrangement shown in FIG. 1; and FIGS. 6 and 7 are schematic views similar to FIG. 3, but showing respectively a three blade impeller in which each blade overlaps the other 20 degrees of arc at an angle of 120 degrees, and a four blade impeller in which each blade overlaps another 15 degrees of arc at an angle of 90 degrees.

Figure 2:
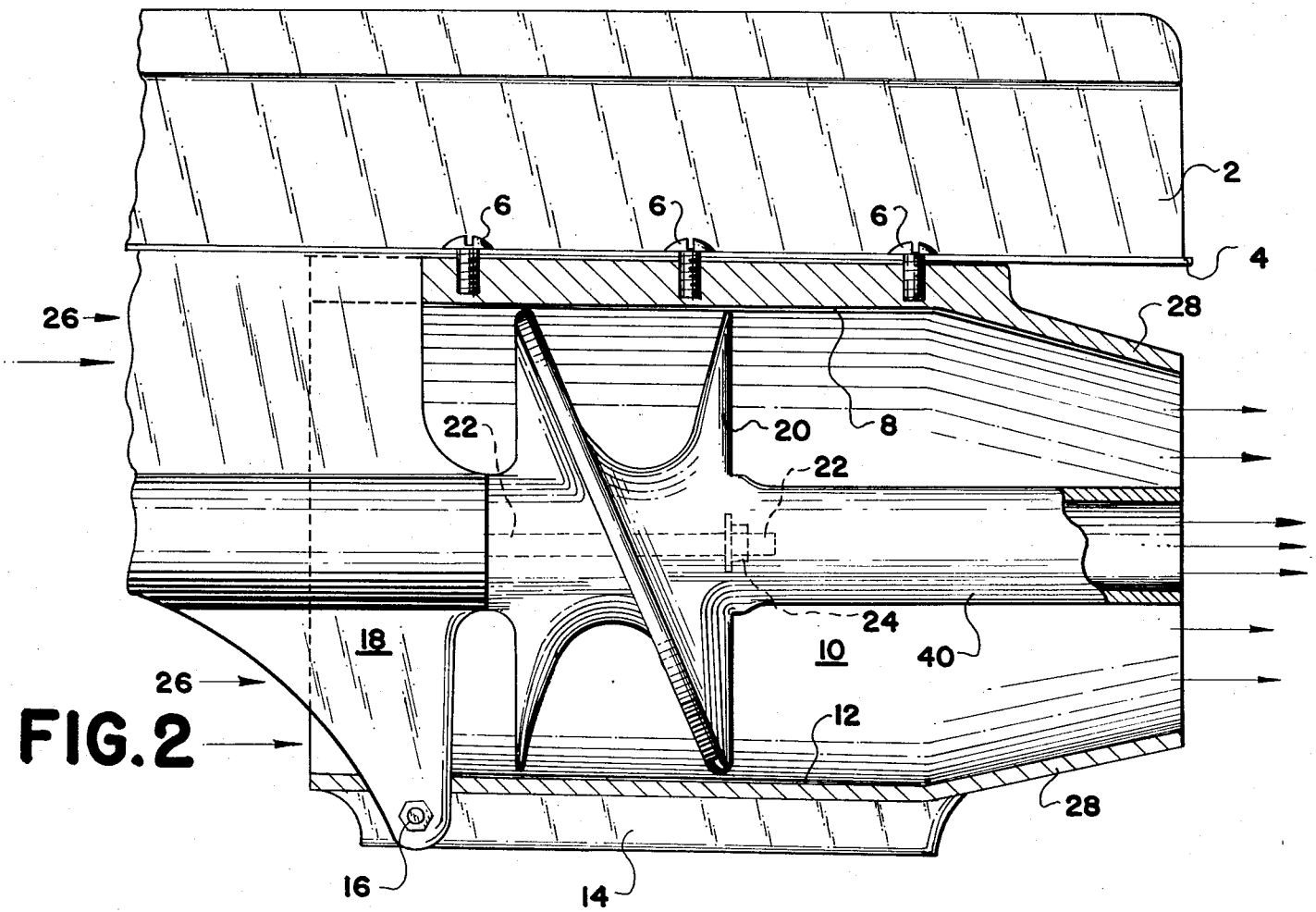
FIG. 2 represents a cross-sectional view of another embodiment of the invention illustrating the exhaustion of the motor combustion gases through a hollow impeller shaft.
Figure 8:
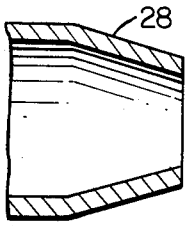

FIG. 8 is a schematic view of a further egress means to those shown in FIGS. 1 and 2.

Turning now to the drawings, in which like reference numerals refer to like parts, reference numeral 2 indicates the exhaust housing of a normal marine propulsion system, either an outboard motor or the drive of an inboard/outboard system. The normal cavitation plate of the system is indicated at 4. Secured to the cavitation plate 4 by means of stud screws 6 is the top portion 8 of the impeller housing 10. Fabricated as an integral part of the lower portion 12 of the housing is drag shoe 14. Lower portion 12 of housing 10 is also secured by means of a screw stud or bolt 16 to the drive head 18.

Fitted within cylindrical housing 10, and of a diameter only slightly smaller than the diameter of the housing, is an axial or screw type impeller 20. This impeller is rotated by shaft 22 and held in place by nut 24, which is an integral part of the diffuser cone 25.

The forward or ingress end of impeller housing 10, generally indicated at 26, is substantially completely open and leads directly to impeller 20 and through the parallel housing sides 8 and 12. Fluid entering the housing through ingress port or means 26 is thus moved by the impeller 20 through impeller cylindrical housing 10 in a horizontal direction, the sides of the housing being parallel causing a substantially non-turbulent condition of fluid flow therethrough.

Fluid egress means, or nozzle 28 as shown in FIG. 1, is of frustoconical configuration, having a cross-sectional area at its leading end of that of housing 10 and converging to a greatly reduced area at its trailing end. In the embodiment shown in FIG. 1, this nozzle is detachably affixed to housing 10 by clamp 30 coacting with ridges 32 on the housing 10 and 34 on nozzle member 28. Thus by releasing clamp 5, which is held in position by means known to the art, not shown, nozzle 28 may be removed and replaced by another having a different convergence ratio, or included angle, and a different A:B ratio.

Fitted within nozzle 28 is a series of vane members 36 whose function it is to maintain the axial flow of liquid reaching the nozzle section and thus preventing or arresting the creation of turbulence therein.

In the embodiment of FIG. 1 exhaust gases from the driving motor are vented by exhaust ports on each side of exhaust housing 2, one of which is illustrated at 38. Exhaust gases can also be expelled via the normal opening in the lower trailing surface of the cavitation plate 4 via an exhaust port which is an integral part of the nozzle 28, as illustrated in FIG. "X".

Turning now to FIG. 2, there is provided an axial impeller 20 having a hollow centered tubular shaft 40 through which exhaust gases from the motor are vented. The tubular shaft has a longitudinal length such that the gases are vented at the trailing end of nozzle 28, thus aiding the exhaust scavenging by Venturi action.

The nozzle 28 is shown in this embodiment as an integral part of the housing 10 but may also be detachably affixed to the housing as shown in FIG. 1.

The construction as shown provides an area of low pressure of between 10 to 20 psig between the impeller and the frustoconical outlet. As noted, the blade substantially fills the cross sectional area of the housing near the inlet port. As shown, the arrangement of the impeller on the shaft defines in the case of both embodiments a substantially axially constant internal flow cross sectional path within the generally parallel side internal flow configuration confines of the housing in any position of movement of the impeller in the housing.

Clearly, the impeller is arranged on the shaft and disposed adjacent to the forward or ingress end of the housing and remote from the rear end or egress end of the housing and in turn remote from the frustoconical nozzle (FIG. 1), or the impeller is arranged on the shaft and disposed at least remote from the rear end or egress end of the housing and in turn remote from the frustoconical nozzle (FIG. 2).

More specifically, as is shown in FIG. 2, the impeller 20 forms a part of the hollow shaft 40 which is connected operatively to the impeller shaft 22 for rotation of the impeller 20 and hollow shaft 40, such that in effect the hollow shaft 40 defines a hollow portion or extension of the overall rotatable shaft means carried by the drive head 18, while the forward portion of the impeller 20 at which the impeller blades are located, and thus the blades themsleves, like the case of the shorter impeller and blade arrangement shown in FIG. 1, are collectively operatively arranged on the shaft 22 and the hollow shaft 40 connected to the shaft 22 for rotation therewith and in turn are collectively disposed more or less adjacent to the forward or ingress end of the housing but at least remote from the rear end or egress end of the housing and thus remote as well from the frustoconical nozzle.

In both the FIG. 1 and FIG. 2 embodiments, therefore, the arrangement of the impeller on the rotatable shaft means defines said axially constant internal flow cross sectional path within said parallel side internal flow configuration confines of the housing in any position of rotational movement of the impeller and its blades in the housing, and the housing has a generally straight horizontal axis with respect to which the above noted pertinent parts are coaxially arranged.

As to the ratio of inlet to exhaust cross sectional areas of the frustrated cone or egress means, it will be seen that said ratio is about 5:1 in FIG. 1, about 1.8:1 or almost 2:1 in FIG. 2, and about 3:1 in FIG. 8.

The drawing discloses in FIG. 3 a two blade impeller in which each blade overlaps the other at an angle of 180°. It will be understood that where three blades are utilized (FIG. 6) the overlap of each blade is at 120°, and where four blades are provided (FIG. 7) the overlap of each blade will be at 90°, etc.

To summarize briefly this invention relates to an improved marine propulsion unit which comprises a housing for an axial fluid impeller substantially filling the area defined by the inner diameter of the housing and the housing having a frustoconical exhaust. The exhaust, which intensifies the thrust of the unit is optimally of a design such that the frustrated cone has an included angle of between about 30° and 60° and has a ratio of inlet to exhaust cross-sectional areas of the frustrated cone of between about 2:1 to 3:1.

As is clear from the drawings (cf. FIGS. 1–3 and 5), although the marine propulsion unit of the present invention is applicable for a motor drive of the outboard, inboard/outboard or inboard system type, the housing 10 and its related parts are themselves all arranged completely externally of the generally longitudinally or horizontally extending outer hull of the marine vessel, and thus outwardly of the external confines of the hull, as well as generally longitudinally or horizontally in generally parallel spaced relation to the hull, and such that the flow of fluid through the unit is correspondingly in generally parallel spaced flow relation to the outer hull.

While the invention has been described in some detail it will be understood that variations and modifications may be made without departing from the spirit of the invention as defined by the scope of the appended claims.

What is claimed is:

1. Thrust intensifying marine propulsion unit for a marine vessel having a generally horizontally extending outer hull, which comprises a fluid flow cylindrical housing of generally parallel side internal flow configuration and having a generally straight horizontal axis and an ingress end and an egress end in axial alignment therewith, said housing being arranged completely externally of the generally horizontally extending outer hull of the marine vessel and generally horizontally in generally parallel spaced relation to such hull for direct open axial flow of fluid through said housing from the ingress end to the egress end thereof and correspondingly in generally parallel spaced flow relation to such generally horizontally extending outer hull, an axial thrust fluid impeller disposed for rotation in said housing and having blades which are arranged in completely overlapping relation with each other and which are disposed for rotation in said housing remote from the egress end thereof, said impeller being arranged on a rotatable shaft means in axial alignment with said housing and with the ingress and egress ends thereof for defining a substantially axially constant internal flow cross-sectional path within the generally parallel side internal flow configuration confines of said housing in any position of rotational movement of said impeller in said housing, direct open axial flow receiving fluid ingress means arranged completely externally of the generally horizontally extending outer hull of the marine vessel and correspondingly in generally parallel spaced relation to such hull and axially at the ingress end of said housing and adjacent to said impeller, said ingress means being substantially in axial alignment with said housing and impeller, and being substantially completely open to direct axial flow of fluid into said ingress means and therethrough correspondingly in generally parallel spaced flow relation to such generally horizontally extending outer hull and leading directly to said impeller in said housing, and fluid egress means arranged completely externally of the generally horizontally extending outer hull of the marine vessel and correspondingly in generally parallel spaced relation to such hull and axially at the egress end of said housing and remote from said impeller blades, said egress means being substantially in axial alignment with said ingress means, housing and impeller, and having a leading end adjacent to said housing and a trailing end remote from said housing and converging from the leading end to the trailing end for providing a reduced internal flow cross-sectional area at the trailing end for propulsion exhausting from the unit of fluid impelled by said impeller, said housing having an internal flow cross-sectional area generally corresponding to the area of said impeller such that the overlapping blades of said impeller substantially fill the cross-sectional area of said housing thereat, and said ingress means having an internal flow cross-sectional area and shape generally corresponding to that of said housing.

2. Unit of claim 1 wherein the egress means is frustoconical in shape.

3. Unit of claim 2 wherein the area between the impeller and the frustoconical egress means provides an area of low pressure of between 10 and 20 psig.

4. Unit of claim 1 wherein the impeller is provided with two blades and each blade overlaps the other 30 degrees of arc at an angle of 180 degrees.

5. Unit of claim 1 wherein the impeller is provided with three blades and each blade overlaps another 20 degrees of arc at an angle of 120 degrees.

6. Unit of claim 1 wherein the impeller is provided with four blades and each blade overlaps another 15 degrees of arc at an angle of 90 degrees.

7. Unit of claim 1 wherein the egress means is detachably affixed to the housing.

8. Unit of claim 1 including means for imparting rotation to the impeller.

9. Unit of claim 8 wherein the means for imparting rotation to the impeller is motor means.

10. Unit of claim 9 wherein the motor means is provided with an exhaust port which is located outside of the housing.

11. Unit of claim 9 wherein the motor means is provided with an exhaust port which is located inside of the housing.

12. Unit of claim 11 wherein the shaft means includes a hollow shaft portion for rotating the impeller and for forming the exhaust port through which the exhaust gases from the motor are vented, thus aiding the exhaust scavenging process for venting such gases.

13. Unit of claim 9 wherein the egress means is detachably affixed to the housing.

14. Unit of claim 9 wherein the egress means is frustoconical in shape and the frustoconical egress means has an included angle between about 30 and 60 degrees.

15. Unit of claim 9 wherein the frustoconical egress means has an area ratio of between 2:1 to 3:1.

* * * * *